US008456792B2

(12) United States Patent
Peczalski et al.

(10) Patent No.: US 8,456,792 B2
(45) Date of Patent: Jun. 4, 2013

(54) SECURE NON-CONTACT SWITCH

(75) Inventors: Andy Peczalski, Eden Prairie, MN (US); Soumitri Kolavennu, Blaine, MN (US); Jeff Hall, Winnebago, IL (US); Todd Hanson, Loretto, MN (US)

(73) Assignee: Honeywell International Inc., Morristown, NJ (US)

( * ) Notice: Subject to any disclaimer, the term of this patent is extended or adjusted under 35 U.S.C. 154(b) by 645 days.

(21) Appl. No.: 12/701,497

(22) Filed: Feb. 5, 2010

(65) Prior Publication Data

US 2011/0193422 A1 Aug. 11, 2011

(51) Int. Cl.
*H01H 47/00* (2006.01)

(52) U.S. Cl.
USPC ..... 361/179

(58) Field of Classification Search
USPC ..... 361/179
See application file for complete search history.

(56) References Cited

U.S. PATENT DOCUMENTS

| | | | |
|---|---|---|---|
| 4,105,899 | A | 8/1978 | Velosa |
| 5,757,672 | A | 5/1998 | Hoepken |
| 5,836,187 | A | 11/1998 | Janssen et al. |
| 6,072,383 | A | 6/2000 | Gallagher, III et al. |
| 6,212,052 | B1 | 4/2001 | Heuer et al. |
| 6,283,514 | B1 | 9/2001 | Letzel |
| 6,311,803 | B1 | 11/2001 | Turk |
| 6,366,532 | B1 | 4/2002 | Hoepken |
| 6,539,760 | B1 | 4/2003 | Letzel et al. |
| 6,570,817 | B2 | 5/2003 | Hoepken |
| 6,659,232 | B2 | 12/2003 | Oelschlegel |

(Continued)

FOREIGN PATENT DOCUMENTS

| | | |
|---|---|---|
| DE | 19540867 | 5/1996 |
| DE | 19624846 | 1/1998 |

(Continued)

OTHER PUBLICATIONS

Rockwell Automation "Sensaguard RFID Coded Non-Contact Interlocks," 2 Pages, Feb. 2008.

(Continued)

*Primary Examiner* — Stephen W Jackson
(74) *Attorney, Agent, or Firm* — Seager Tufte & Wickhem LLC.

(57) ABSTRACT

A redundant non-contact switch reports a status as closed or open for a first member and a second member that move relative to each other between an open state and a closed state. In some embodiments, the redundant non-contact switch includes a wireless authentication (WA) pair and a magnetic pair. The WA pair may include a WA responder attached to one of the first member and the second member, and a WA interrogator attached to the other of the first member and the second member. The WA pair may be configured to register a WA status of closed or open, depending on a WA authentication between the WA responder and the WA interrogator. The magnetic pair may include a magnet attached to one of the first member and the second member, and a magnet sensor attached to the other of the first member and the second member. The magnetic pair may be configured to register a magnetic status of closed or open, depending on whether a magnet distance between the magnet and magnet sensor is beyond a threshold magnet distance. In some instances, the redundant non-contact switch reports the status as closed only if both the WA status is registered as closed and the magnetic status is registered as closed.

23 Claims, 9 Drawing Sheets

U.S. PATENT DOCUMENTS

| | | | | |
|---|---|---|---|---|
| 7,034,683 | B2 * | 4/2006 | Ghazarian | 340/568.1 |
| 7,086,111 | B2 | 8/2006 | Hilscher et al. | |
| 7,357,429 | B2 | 4/2008 | Eichenauer | |
| 7,377,560 | B2 | 5/2008 | Wiemer et al. | |
| 7,469,838 | B2 | 12/2008 | Brooks et al. | |
| 7,474,211 | B2 | 1/2009 | Kramer | |
| 7,492,905 | B2 | 2/2009 | Fitzgibbon | |
| 7,504,747 | B2 | 3/2009 | Pullmann et al. | |
| 7,520,426 | B2 | 4/2009 | Hoepken et al. | |
| 7,545,620 | B2 | 6/2009 | Klees | |
| 7,696,878 | B2 | 4/2010 | Cable et al. | |
| 2005/0108945 | A1 | 5/2005 | Wiemer et al. | |
| 2006/0220846 | A1 | 10/2006 | Stratmann | |
| 2006/0226948 | A1 | 10/2006 | Wright et al. | |
| 2007/0013236 | A1 | 1/2007 | Fleiner et al. | |
| 2007/0205861 | A1 | 9/2007 | Nair et al. | |
| 2008/0048826 | A1 | 2/2008 | Agrawal et al. | |
| 2009/0058607 | A1 | 3/2009 | Hou et al. | |
| 2010/0079289 | A1 | 4/2010 | Brandt et al. | |
| 2010/0097186 | A1 | 4/2010 | Wielebski et al. | |

FOREIGN PATENT DOCUMENTS

| | | |
|---|---|---|
| DE | 102006038036 | 11/2007 |
| EP | 0287686 | 10/1988 |
| WO | 0034605 | 6/2000 |
| WO | 2008041143 | 4/2008 |
| WO | 2008131704 | 11/2008 |

OTHER PUBLICATIONS

Euchner, "Non-Contact Safety Systems CES-A/CES-AZ," 11 pages, prior to Feb. 5, 2010.

Engineer Live, "Safety Switch Uses RFID Technology," 3 pages, Jul. 17, 2009.

Etta, "New Non-Contact Safety Interlocks Satisfy Safety Category 3 or 4 Requirements," 10 pages, prior to Feb. 5, 2010.

Rockwell Automation Inc, "Integrated Saftey, Let the Ripple-Effect Increase Your Bottom Line," Brochure, 6 pages, 2008.

Schmersal Ltd., "RFID Key-Operated Selector Switch," 1 page, Apr. 14, 2008.

* cited by examiner

SECURE NON-CONTACT SWITCH

TECHNICAL FIELD

The disclosure relates generally to switches, and more particular to non-contact type switches.

BACKGROUND

Non-contact type switches are commonly used in a wide variety of applications. For example, non-contact type switches are commonly used in interlock systems that restrict access to certain areas or equipment. For example, in an industrial setting, a potentially hazardous robot may be surrounded by a barrier that has an entrance gate. The gate may be equipped with a non-contact type switch whose state depends on whether the gate is open or closed. If the non-contact type switch indicates an open gate, a controller may command the robot to enter a safe state, such as a non-moving state.

In some instances, non-contact type switches may be willfully defeated in order to bypass certain safety or other features provided by the non-contact type switches. For example, if a non-contact type switch on one side of a gate is operated by a magnetic relay, the operator may permanently attach a magnet to the relay, thereby permanently closing the relay even when the gate is opened. What would be desirable, therefore, is a more secure non-contact type switch that would be more difficult to defeat. Such a non-contact type switch would have a wide variety of applications, including many interlock applications.

SUMMARY

The disclosure relates generally to switches, and more particular to non-contact type switches. In an illustrative but non-limiting example, the disclosure provides a redundant non-contact switch for reporting, for example, a status of closed or open for a first member and a second member that move relative to each other between an open state and a closed state. An illustrative redundant non-contact switch may include a wireless authentication (WA) pair and a magnetic pair. The WA pair may include a WA responder attached to one of the first member and the second member, and a WA interrogator attached to the other of the first member and the second member. The WA pair is configured to register a WA status of closed or open, depending on a WA authentication between the WA responder and the WA interrogator. The magnetic pair may include a magnet attached to one of the first member and the second member, and a magnet sensor attached to the other of the first member and the second member. The magnetic pair may be configured to register a magnetic status of closed or open, depending on whether a magnet distance between the magnet and magnet sensor is beyond a threshold magnet distance. In some instances, the redundant non-contact switch may be configured to report the status as closed only if both the WA status is registered as closed and the magnetic status is registered as closed.

In some instances, operation of the WA authentication and/or the magnetic pair relies on inductive power transmission. In one example, a transmit coil may be attached to one of the first member and the second member, and a receive coil may be attached to the other of the first member and the second member. When so provided, sufficient operational power may only be provided for the WA authentication and/or the magnetic pair when the distance between the transmit coil and the receive coil is within a threshold distance.

The above summary is not intended to describe each and every disclosed illustrative example or every implementation of the disclosure. The Description that follows more particularly exemplifies various illustrative embodiments.

BRIEF DESCRIPTION OF THE FIGURES

The following description should be read with reference to the drawings. The drawings, which are not necessarily to scale, depict selected illustrative embodiments and are not intended to limit the scope of the disclosure. The disclosure may be more completely understood in consideration of the following detailed description of various illustrative embodiments in connection with the accompanying drawings, in which.

DESCRIPTION

The following description should be read with reference to the drawings, in which like elements in different drawings are numbered in like fashion. The drawings, which are not necessarily to scale, depict selected illustrative embodiments and are not intended to limit the scope of the disclosure. Although examples of construction, dimensions, and materials are illustrated for the various elements, those skilled in the art will recognize that many of the examples provided have suitable alternatives that may be utilized.

Figure 1:
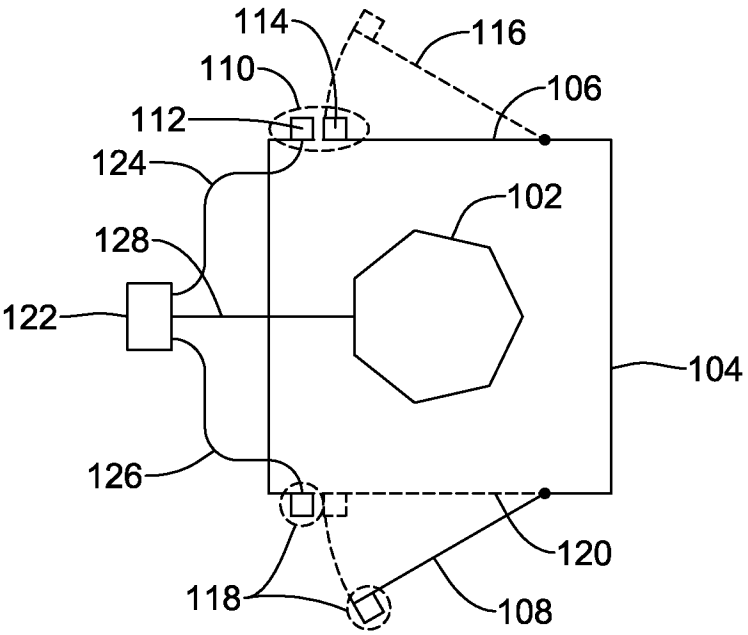
FIG. 1 is a schematic plan view of a machine, device, or item protected by an illustrative interlock system.

FIG. 1 is a schematic plan view of a machine, device, or item 102 protected by an illustrative interlock system. Machine, device, or item 102 may be any suitable item for which it may be desired to provide protection with an interlock system, such as the interlock system shown in FIG. 1. Device 102 is disposed within a barrier 104, which has a first door 106 and a second door 108. First door 106 is equipped with a non-contact switch 110 having a first part 112 and a second part 114. First door 106 is illustrated in a closed position, with a phantom representation 116 showing the first door in an open position. Second door 108 is also equipped with a non-contact switch 118 and is shown in an open position, with a phantom representation 120 showing the second door in a closed position. First and second non-contact switches 110, 118 are connected to an interlock system controller 122 via communication links 124, 126, which may use any suitable communication method, such as hard wired, optical, radio, and the like. The communication links 124, 126 provide a way for first and second non-contact switches 110, 118 to communicate their current status such as 'open' or 'closed' to the interlock system controller 112. In the example shown, the interlock system controller 122 is also connected by a communication link 128 to machine 102, so that it may, for example, communicate an unsafe or open condition to the machine, which may shut down, enter a safe condition, or take any other appropriate action as desired.

FIG. 1 shows an illustrative interlock system installation. In some other illustrative embodiments, fewer or greater than two doors may be employed in such a system. The interlock system may be configured with any other suitable components, such as stop, trip and/or enabling switches, interlock keys, presence sensing devices, and so on. Machine, device, or item 102 may be any one or multiple object(s) for which interlock system protection is desired, or may not necessarily be present or disposed in barrier 104 at all; the interlock system may protect a region of space, or those entering a space, or may be used in any other suitable manner, as desired.

Figure 2A:
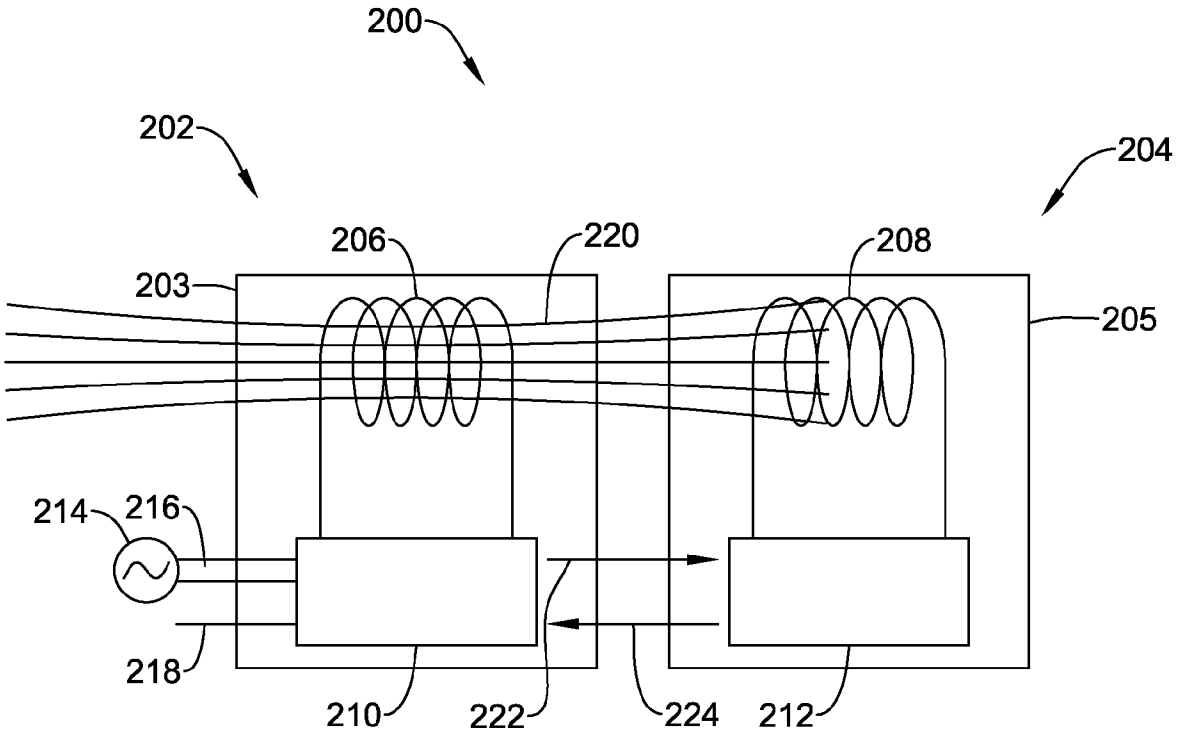
FIG. 2*a* is a schematic diagram of an illustrative non-contact switch having first and second parts in close proximity within a threshold distance of each other.
Figure 2B:
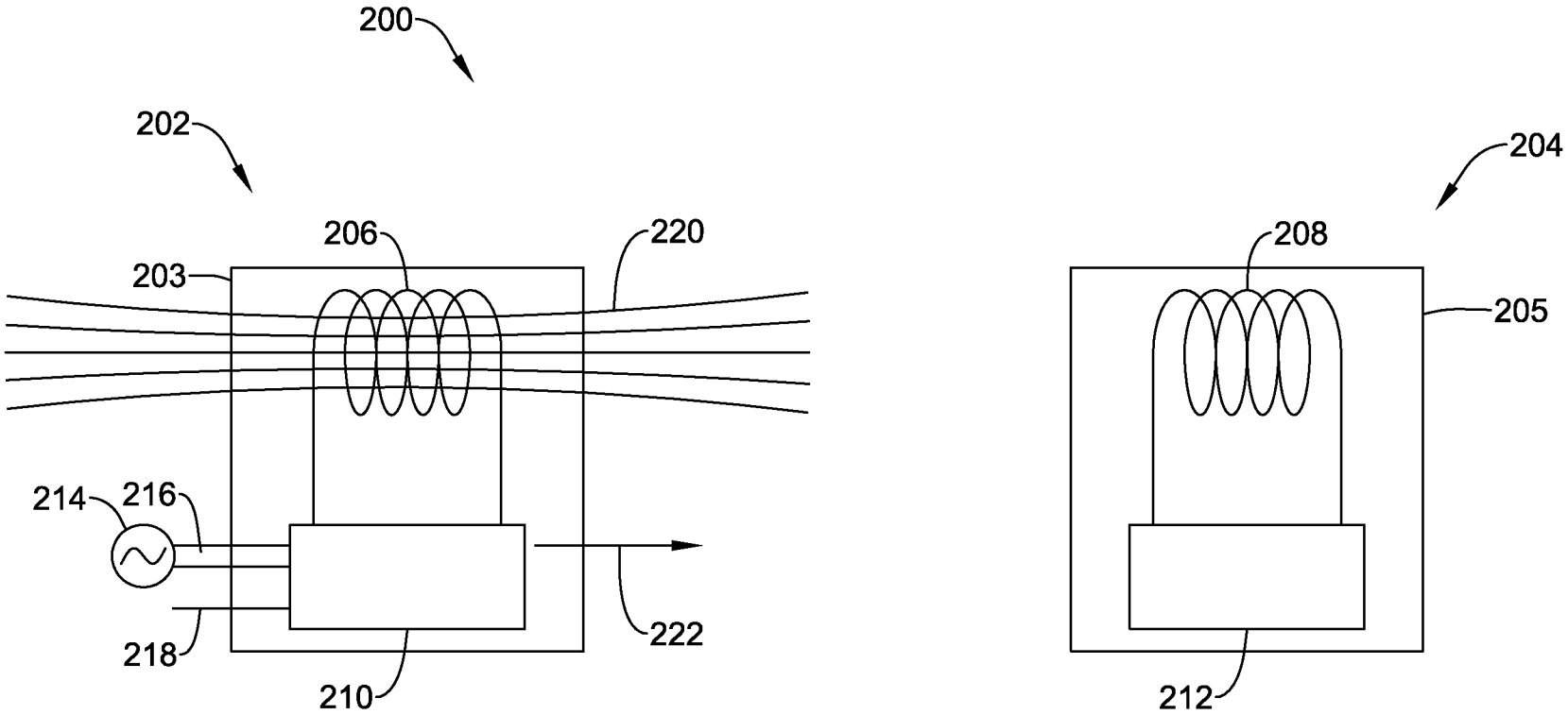
FIG. 2*b* is a schematic diagram of the illustrative non-contact switch of FIG. 2*a*, showing the first and second parts separated by more than a threshold distance.

FIGS. 2*a* and 2*b* are schematic diagrams of an illustrative non-contact switch 200, and in some instances may be used as either of switches 110 or 118 in the illustrative interlock system of FIG. 1 as one example. Components of the illustrative non-contact switch 200 are generally divided between a first part 202 and a second part 204. Components of each part may be housed in a common enclosure, such as first enclosure 203 and second enclosure 205, as shown in the illustration, but this is not required. Generally, first part 202 (i.e., the collection of components of switch 200 belonging to the first part) is mounted, attached, or otherwise disposed on a first member or structure (not shown), and second part 204 is mounted, attached, or otherwise disposed on a second member or structure (not shown), where the first and second members may move relative to each other between an open state and a closed state. For example, second part 204 may be mounted on a door stile, such as first door 106 of FIG. 1, and first part 202 may be mounted on a door jamb. When so provided, when the door is closed, components of the first and second parts are brought into close proximity (e.g. within a threshold distance), and when the door is open, components of the first and second parts are separated by some distance (e.g. greater than a threshold distance).

FIG. 2*a* illustrates the first and second parts 202, 204 of the illustrative non-contact switch 200 in close proximity, as may be the case when a door with which the switch is associated is closed. FIG. 2*b* illustrates first and second parts 202, 204 of non-contact switch 200 separated by a greater distance as compared to FIG. 2*a*, as may be the case when a door with which the switch is associated is open. While FIG. 2*b* shows the first part 202 and the second part 204 separated left-to-right, relative to the figure, the first and second parts may be separated in other directions as well, such as up-down, or along an arbitrary axis. First and second parts 202, 204 may be rotated relative to each other as the first and second members to which they are respectively attached move relative to each other.

Non-contact switch 200 of FIG. 2 may be structured and configured so that it reports a status of closed only if first part 202 and second part 204 are disposed or positioned relative to each other appropriately, as discussed further herein. Being disposed relative to each other appropriately may include being separated by or within (e.g. less than) an appropriate displacement and/or distance, and/or may include being oriented with an appropriate rotational attitude with respect to each other. These displacement, distance, and/or attitude/orientation characteristics may apply to any non-contact switch of the present disclosure, and physical means for achieving switch functionality based upon such characteristics are further described herein.

The illustrative non-contact switch 200 may also be structured and configured such that it reports a status of closed only if a wireless authentication (WA) is successfully achieved between the first part 200 and the second part 204, in which a WA responder component of the second part properly identifies itself to a WA interrogator component of the first part. This wireless authentication functionality may apply to any non-contact switch of the present disclosure. Various implementations of wireless authentication are further described herein.

The illustrative non-contact switch 200 of FIGS. 2*a* and 2*b* may include an inductive power transmission pair including an inductive power transmit coil 206 and an inductive power receive coil 208. The illustrative non-contact switch 200 of FIGS. 2*a* and 2*b* also includes a wireless authentication pair including a WA interrogator 210 and a WA responder 212. Inductive power transmit coil 206 and inductive power receive coil 208 may also serve as antennas for WA interrogator 210 and WA responder 212 respectively, although this is not required. In some illustrative embodiments, either or both of WA interrogator 210 and WA responder 212 may have an antenna or antennas distinct from the inductive power coils 206, 208, or they may not employ distinct antennas. In some instances, WA interrogator 210 and WA responder 212 may include antennas that replace inductive power coils 206, 208, such as when WA interrogator 210 and/or WA responder 212 are implemented using, for example, a Surface Acoustical Wave (SAW) device that is powered through an antenna and produces a corresponding ID signal using the same or a different antenna.

As illustrated in FIGS. 2*a* and 2*b*, inductive power transmit coil 206 is connected to a power supply 214 via power lines 216, sometimes through WA interrogator 210, although this is not required. With power lines 216 passing through the WA interrogator 210, the interrogator may be said to provide power to the inductive power transmit coil 206, and if sufficiently close, to the WA responder 212. In some illustrative embodiments, inductive power transmit coil 206 may be connected to power supply 214 independently of WA interrogator 210, which may receive power from the same power supply through a separate connection, or from a different power supply (not shown). In FIGS. 2*a* and 2*b*, power supply 214 is illustrated as being external to enclosure 203 housing components of first part 202, but this is not necessary. In some illustrative embodiments, an enclosure for a first part of a non-contact switch may house an internal power supply, such as a battery.

In FIGS. 2*a* and 2*b*, first part 202 of non-contact switch 200 is attached to a cable 218 that may provide a communication link to an interlock system controller (not shown) or some other system, although this is not necessary. Cable 218 may be electrical or optical or may employ any suitable communication technology. In some illustrative embodiments, a communication link may be provided without a physical cable, such as through radio, optical, or any other appropriate technology. In some illustrative embodiments where a physical cable such as cable 218 is used, the cable may share a common physical path with power lines such as power lines 216. In some illustrative embodiments, communication cables and power lines may be combined, such that power and information may travel over the same conductors.

Inductive power receive coil 208 may be configured to provide operational power to WA responder 212, which in some instances, may require operational power from the inductive power receive coil to operate. Inductive power transmit coil 206 and inductive power receive coil 208 may be configured so that the inductive power receive coil 208 receives sufficient operational power to operate the WA responder 212 only when the inductive power coils 206, 208 are positioned proximally with respect to each other within a limited range of displacement (e.g. less than a threshold distance) and/or mutual orientation. These positioning criteria for the inductive power coils 206, 208 to transfer operational power may be effectively the same condition discussed herein where non-contact switch 200 reports a status of closed only if first part 202 and second part 204 are disposed relative to each other appropriately.

The positioning criteria for inductive power transfer arise at least in part from the fundamental physical phenomenon of Faraday induction upon which the power transfer is based. When inductive power transmit coil 206 carries a time-varying current, it produces a time-varying magnetic field, illustrated schematically with flux lines 220. The varying magnetic flux through receive coil 208, and hence the induced voltage/current in the coil, depends in part upon the relative positioning of the power transmit coil 206 and the power receive coil (e.g. separation distance). As the relative displacement and/or orientation of the coils 206, 208 change, the power induced in the induced power receive coil changes. This may account for whether the WA responder 212 receives sufficient operational power to operate the WA responder.

In FIG. 2*a*, the inductive power coils 206, 208 of the inductive power transmission pair are shown in close proximity (less than a threshold distance), such that a significant magnetic flux from the transmission coil 206 is captured by the receive coil 208, resulting in transfer of sufficient operational power to the WA responder 212. In FIG. 2*b*, the inductive power coils 206, 208 of the inductive power transmission pair are shown separated by a considerable displacement (e.g. greater than a threshold distance), such that insufficient magnetic flux from the transmission coil 206 is captured by the receive coil 208 to result in transfer of sufficient operational power to the WA responder 212.

In some illustrative embodiments, additional circuitry (not shown) may be provided in the second part 204 of the non-contact switch 200. Such circuitry may, for example, analyze the electrical signal induced in the inductive power receive coil 208 to discern whether the transmit 206 and receive coils are positioned with respect to each other appropriately to satisfy the closed condition. If they are, the additional circuitry may allow operational power to pass to the WA responder 212. If they are not, the additional circuitry may prevent operational power from passing to the WA responder 212.

In some illustrative embodiments, operational power is received by an inductive power receive coil 208 from an inductive power transmit coil 206 only when the coils are positioned within a threshold distance of each other. This condition may essentially be equivalent, in some embodiments, to the WA distance between the WA interrogator and responder being below a threshold WA distance. These threshold distances may be, for example, about 10 mm. In some illustrative embodiments, operational power is received by an inductive power receive coil 208 from an inductive power transmit coil 206 only when the coils are positioned within a pre-defined range of displacement, and within a pre-defined range of rotational orientation, with respect to each other.

The wireless authentication pair including WA interrogator 210 and a WA responder 212 may employ any suitable communication method, such as but not limited to, radio, acoustic, and optical, and any suitable protocol, including but not limited to RFID protocols, Wi-Fi (including IEEE 802.11 and related standards), ZigBee (including IEEE 802.15.4 and related standards), and so on. To perform a wireless authentication, WA interrogator 210 may broadcast an interrogation signal 222, schematically represented with an arrow directed toward WA responder 212. In some cases, WA interrogator 210 may employ inductive power transmit coil 206 as an antenna. In some embodiments, the interrogation signal 222 may be encoded upon the time-varying magnetic flux used to transfer power to inductive power receive coil 208. Inductive power receive coil 208, in turn, may be employed by WA responder 212 as an antenna. Upon receiving an interrogation signal 222 from the WA interrogator 210, and when sufficiently supplied with operational power, WA responder 212 may reply with a response signal 224, schematically represented with an arrow directed toward the WA interrogator in FIG. 2*a*. (In FIG. 2*b*, the WA responder 212 does not respond, as it is not provided with sufficient operational power). Response signal 224 may be an authenticating response including an identification code such that WA interrogator 210 may determine whether the response signal matches a known identification code, and hence, matches an expected authenticating response. A WA interrogator 210 may be configured to register a WA status of closed only if such a successful authenticating match is made, and to register a WA status of open otherwise. For switch 210, WA status of closed or open may coincide with a switch status of closed or open. In some instances, the WA interrogator 210 may communicate a status of closed or open to an interlock system controller through a communication link, such as one using cable 218. In some embodiments of interlock systems, authentication/identifications codes may be managed such that each interlock switch employs one or more essentially unique codes, such that interrogators and responders of WA pairs essentially uniquely matched.

In some illustrative embodiments, "rolling" or "hopping" systems for varying codes may be employed.

In some illustrative embodiments, for additional security a WA interrogator as well as a WA responder may broadcast an identification code, and the WA responder may be configured to broadcast its authenticating response only if it receives a known identification code from the interrogator. Such secure authenticating procedures may be employed to make it more difficult to willfully bypass the switch.

In some illustrative embodiments, it may be desired to provide a switch bypass or override capability. In such cases, a third wireless transceiver, in addition to the interrogator and responder of a WA pair, may be used in a disarming key and brought into proximity of the interrogator. A disarming key may include other components as well, such as a magnetic component to serve as part of a magnetic pair. The third wireless transceiver may mimic the nominal WA responder, or it may broadcast its own distinct identification code that the WA interrogator may be programmed to accept as a known bypass identification code. Such a switch bypass capability may provide multiple advantages over older switch technologies. For example, a bypass disarming key having a distinctive bypass identification code may make it possible for an interlock system controller to be aware that a bypass disarming key is in use, instead of the nominal second part corresponding to the first part of the switch. The controller and/or switch may, for example, log the information for later review, and/or the controller may take or command actions in view of the use of the bypass disarming key, such as issuing warnings or limiting machine operations. In some illustrative embodiments, any appropriate information about any attempted status changes of a non-contact switch may be logged, such as status changes (closed to open, open to closed), authentication attempts, the success or failure of authentication attempts, the time of attempts, identification codes received, whether a bypass disarming key was used, etc. Logged information may be read out in any appropriate way, such as over cable 218 or any optical, wired, or wireless communication link.

In some instances, WA transceivers may be supplied by a manufacturer with pre-programmed identification codes (RFID tags with pre-programmed codes, SAW sensors with pre-programmed codes, etc.). In other instances, WA transceivers may be supplied in a field-programmable form. It may be possible to program WA pairs via, for example, an interlock system controller such as controller 122 of FIG. 1, or via additional or other hardware if desired. In some embodiments, a field programming device for WA transceivers may be used as a bypass disarming key or device, if desired.

Figure 3A:
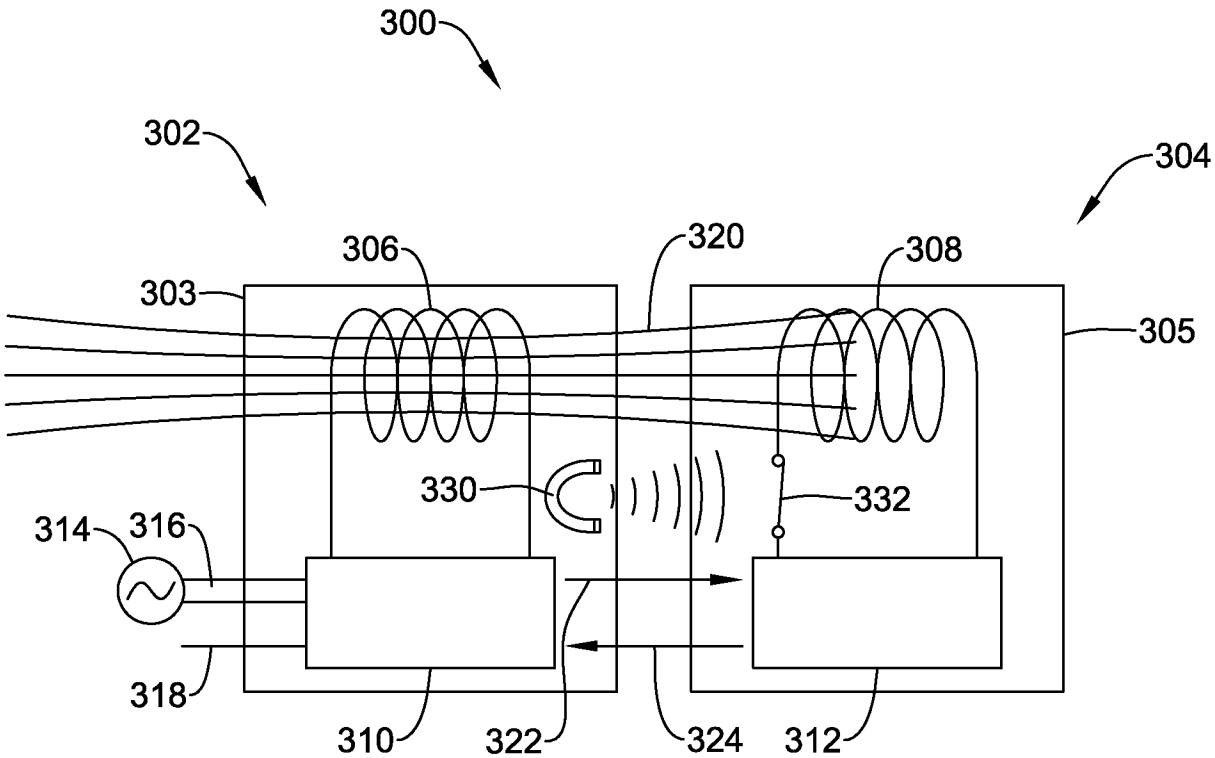
FIG. 3*a* is a schematic diagram of an illustrative non-contact switch with a magnet pair having first and second parts in close proximity within a threshold distance.
Figure 3B:
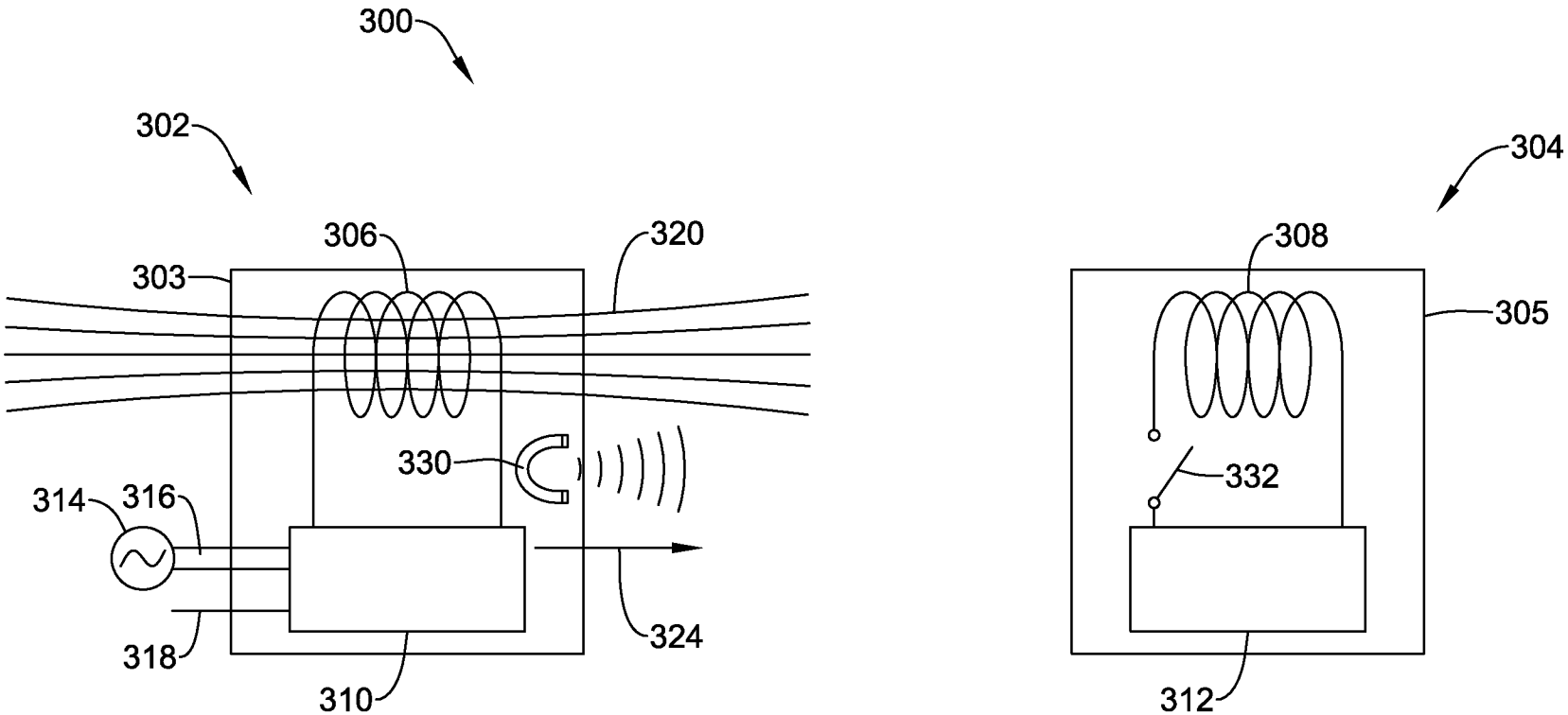
FIG. 3*b* is a schematic diagram of the illustrative non-contact switch of FIG. 3*a*, showing the first and second parts separated by more than a threshold distance.

FIGS. 3*a* and 3*b* are schematic diagrams of an illustrative non-contact switch 300, and in some instances may be used as either of switches 110 or 118 in the illustrative interlock system of FIG. 1 as one example. The components of switch 300 may be structured and configured with features of switch 200 of FIGS. 2*a* and 2*b*, or any features described in other illustrative embodiments of switches of the present disclosure, to the extent that they are compatible with the implementation in switch 300 of a magnetic pair. In the illustrative embodiment, the magnetic pair of switch 300 may include a magnet 330 and a magnet sensor 332. The magnetic pair may be configured to register a magnetic status of open or closed depending on the displacement and/or orientation of the magnet 330 relative to the magnet sensor 332. In some illustrative embodiments, the magnetic pair may be configured to register a magnetic status of closed or open, depending on whether a magnet distance between the magnet and magnet sensor is beyond a threshold magnet distance. If the magnet distance is beyond a threshold magnet distance, the magnetic pair may register a magnetic status of open, and if the magnet distance is within a threshold magnet distance, the magnetic pair may register a magnetic status of closed.

The magnetic pair of switches 300 of FIGS. 3*a* and 3*b* may be based upon any suitable magnetic technology. Magnetic sensor 332 may be any suitable magnetic sensor, such as a simple mechanical magnetic switch, a magnetic relay switch and/or another other suitable magnetic sensor. In some instances, the magnetic sensor may be based upon physical phenomena such as magnetoresistance, the Hall effect, and so on.

In FIGS. 3*a* and 3*b*, magnetic sensor 332 is schematically illustrated as a magnetically-actuated switch that closes (conducts) when first part 302 and second part 304 of switch 300 are disposed within a threshold magnet distance (FIG. 3*a*), and opens (does not conduct) when the parts are separated by more than the threshold magnet distance (FIG. 3*b*). In the illustrative embodiment shown in FIGS. 3*a* and 3*b*, magnetic sensor/switch 332 is schematically shown as being electrically connected between inductive power receive coil 308 and WA responder 312. Arranged thusly, magnetic sensor/switch 332 may allow (when closed) or prevent (when open) reception of an interrogation signal 322 by the WA responder 312, by connecting or disconnecting the WA responder 312 from the inductive power receive coil/antenna 308. That is, when the magnetic sensor/switch 332 is open, power may not be delivered to the WA responder 312.

In some illustrative embodiments, a magnetic sensor/switch may not physically make or break an electrical connection between a coil/antenna and responder, but may provide a signal of magnetic status (closed or open), and the responder, for example, may be configured to then accept or ignore input from the coil/antenna. Regardless of the particular implementation details, and in some instances, switch 300 may be configured so that it reports the status as closed only if both the WA status is registered as closed and the magnetic status is registered as closed. Note that as the positions of the first and second parts 302, 304 of switch 300 change with respect to each other, as would happen, for example, when the first and second parts move along with first and second members to which they are attached, the WA distance and magnet distance vary.

Figure 4A:
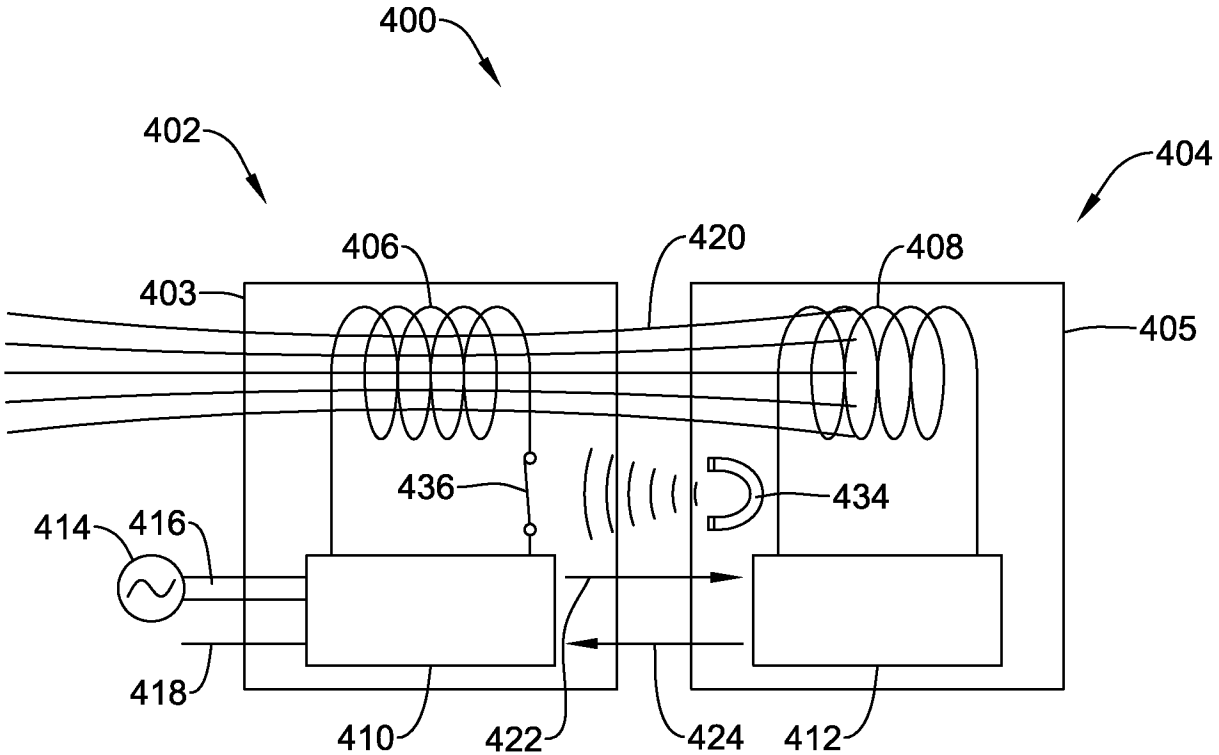
FIG. 4*a* is a schematic diagram of an illustrative non-contact switch having first and second parts in close proximity, with a magnet pair in an alternate arrangement.
Figure 4B:
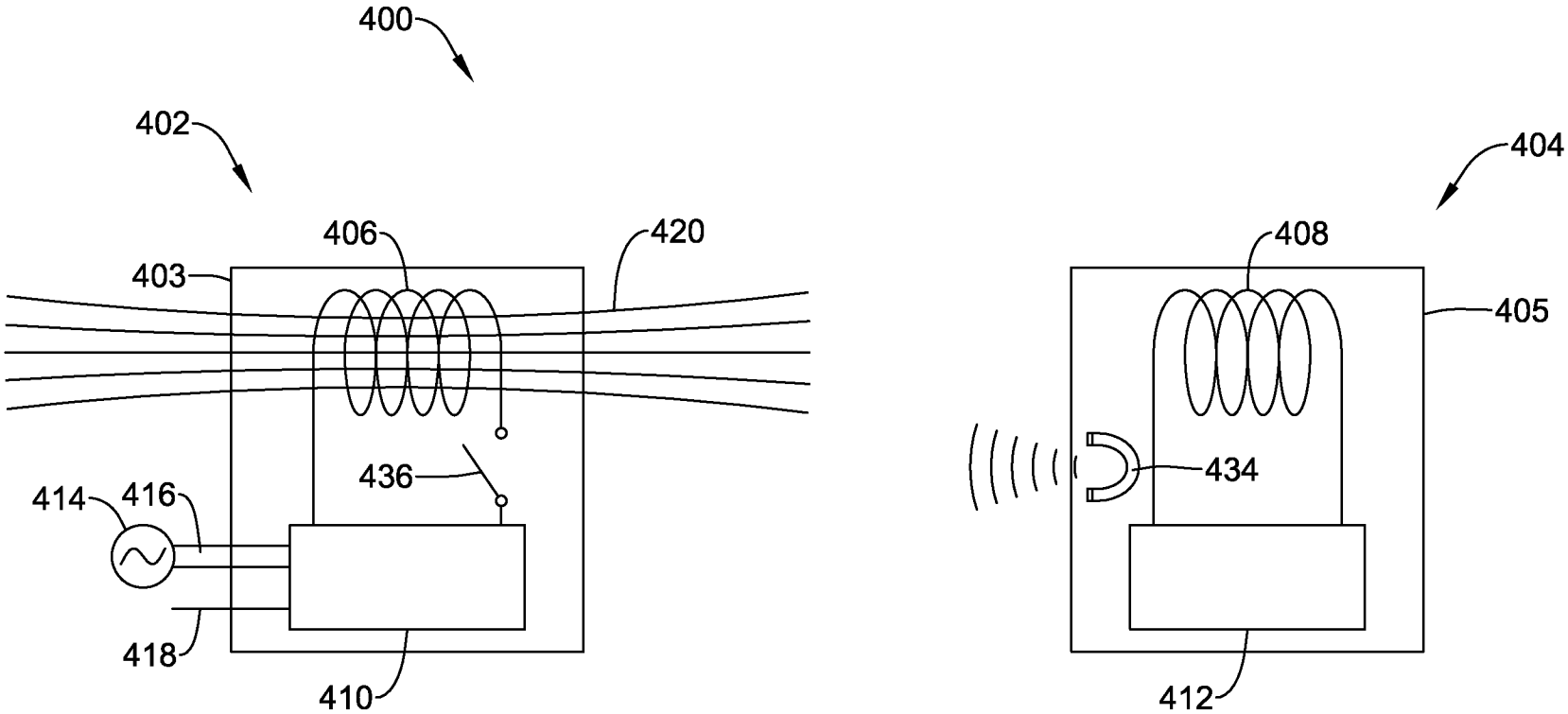
FIG. 4*b* is a schematic diagram of the illustrative non-contact switch of FIG. 4*a*, showing the first and second parts separated by more than a threshold distance.

Other arrangements of a magnet pair in a switch are contemplated. For example, FIGS. 4*a* and 4*b* are schematic diagrams of another illustrative non-contact switch 400. Like switch 300, the components of switch 400 may be structured and configured with features of switch 200 of FIGS. 2*a* and 2*b*, or any features described in other illustrative embodiments of switches of the present disclosure, to the extent that they are compatible with the implementation in switch 400 of a magnetic pair. The magnetic pair of switch 400 includes a magnet 434 and a magnet sensor 436. The magnetic pair may be configured to register a magnetic status of open or closed depending on the relative displacement and/or orientation of the magnet 434 and magnet sensor 436. In some illustrative embodiments, the magnetic pair is configured to register a magnetic status of closed or open, depending on whether a magnet distance between the magnet and magnet sensor is beyond a threshold magnet distance. If the magnet distance is beyond a threshold magnet distance, the magnetic pair may register a magnetic status of open, and if the magnet distance is within a threshold magnet distance, the magnetic pair may register a magnetic status of closed.

As with magnetic pair of switch 300, the magnetic pair of switch 400 of FIGS. 4*a* and 4*b* may be based upon any suitable magnetic technology, and magnetic sensor 436 may be any suitable magnetic sensor. In FIGS. 4*a* and 4*b*, magnetic sensor 436 is schematically illustrated as a magnetically-actuated switch that closes (conducts) when first part 402 and second part 404 of switch 400 are disposed within a threshold magnet distance (FIG. 4*a*), and opens (does not conduct) when the parts are separated by more than the threshold magnet distance (FIG. 4*b*). In FIGS. 4*a* and 4*b*, magnetic sensor/switch 436 is schematically illustrated as being electrically disposed between inductive power transmit coil 406 and WA interrogator 410. As such, magnetic sensor/switch 436 may allow (when closed) or prevent (when open) either or both of supplying power to the inductive power transmit coil 406, and providing an interrogation signal 422 from WA interrogator 410 to the coil for broadcast to the WA responder 412. In some illustrative embodiments, power from power supply 414 is not routed through the WA interrogator to the inductive power transmit coil 406, but the first part 402 of the switch may still be configured so that the power is supplied or not supplied to the transmit coil depending on the magnetic status and the state of magnetic sensor/switch 436. In some illustrative embodiments, a magnetic sensor/switch may not physically make or break an electrical connection between a coil/antenna and responder, but may provide a signal of magnetic status (closed or open), and other components of the first part may be configured to achieve the result of controlling transmission of power and/or signals to the coil/antenna. In some illustrative embodiments, a magnetically-actuated switch may be disposed between a power supply and a WA interrogator, such that the magnetically-actuated switch, when closed, allows power to be provided to the WA interrogator, and when open, does not allow power to be provided to the WA interrogator. Regardless of the particular implementation details, and in some instances, switch 400 may be configured so that it reports the status as closed only if both the WA status is registered as closed and the magnetic status is registered as closed. As with switch 300, as the positions of the first and second parts 402, 404 of switch 400 change with respect to each other, as would happen, for example, when the first and second parts move along with first and second members to which they are attached, the WA distance and magnet distance vary.

Figure 5A:
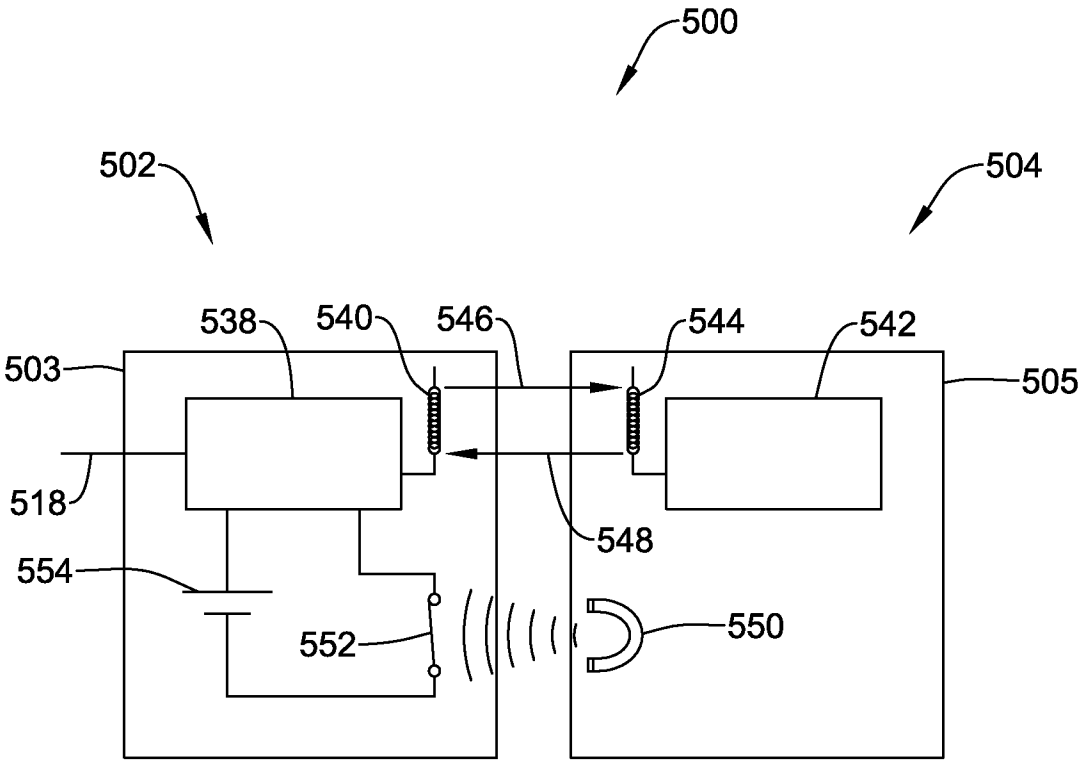
FIG. 5*a* is a schematic diagram of another illustrative non-contact switch having first and second parts in close proximity.
Figure 5B:
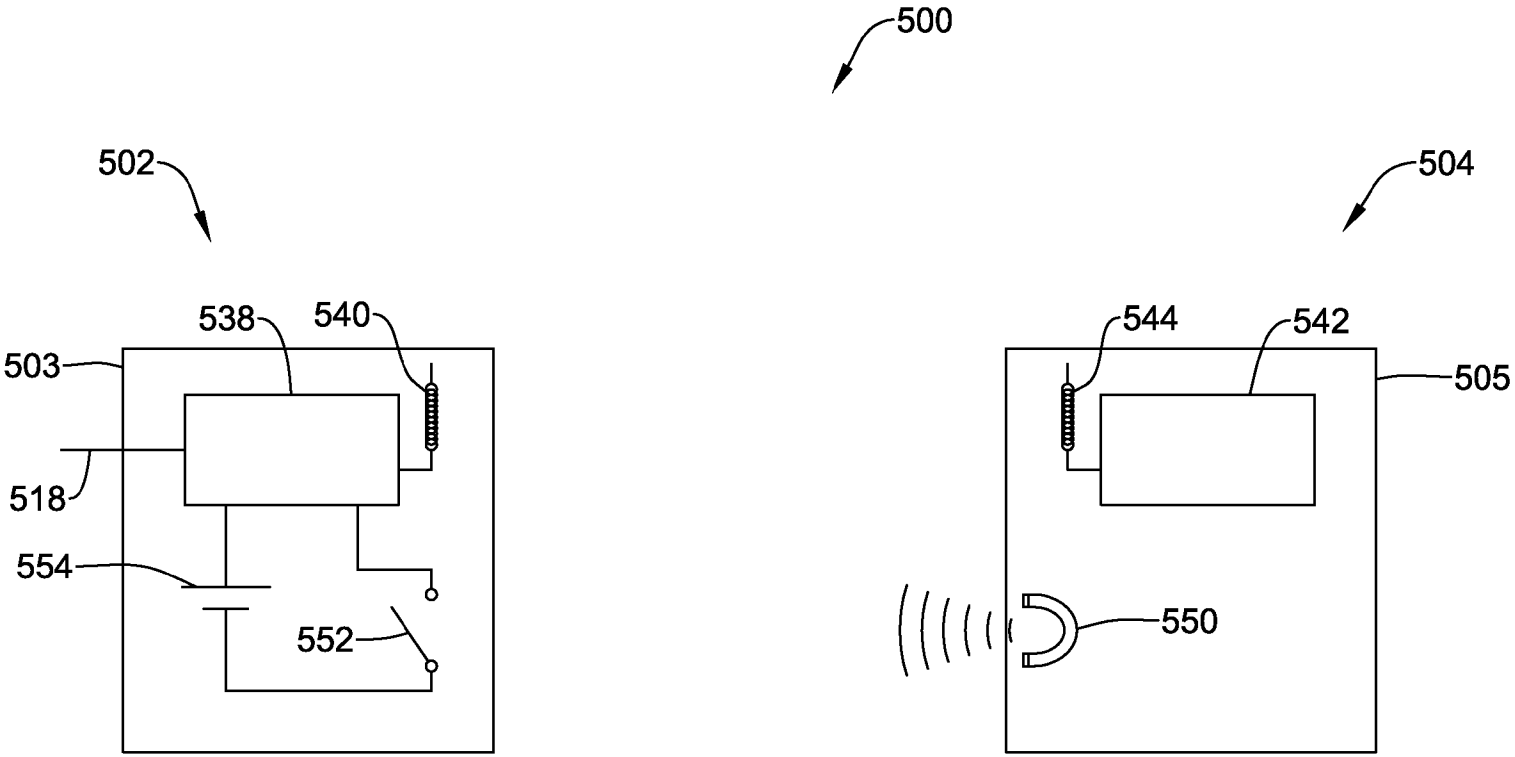
FIG. 5*b* is a schematic diagram of the illustrative non-contact switch of FIG. 5*a*, showing the first and second parts separated by more than a threshold distance.

FIGS. 5*a* and 5*b* are schematic diagrams of an illustrative non-contact switch 500, and in some instances may be used as either of switches 110 or 118 in the illustrative interlock system of FIG. 1 as one example. The components of switch 500 may be structured and configured with any features described in other illustrative embodiments of switches of the present disclosure, to the extent that they are compatible with the other disclosed features of switch 500.

Illustrative non-contact switch 500 may include a wireless authentication pair including a WA interrogator 538 which may have an antenna 540 and a WA responder 542 which may have an antenna 544. The wireless authentication pair of switch 500 may employ any suitable technologies and protocols as further disclosed elsewhere herein. In particular, the wireless authentication pair of switch 500 may incorporate Radio Frequency IDentification (RFID) technology and/or Surface Acoustic Wave (SAW) technology. WA responder 542 may be an RFID tag or a SAW tag, or an RFID tag incorporating SAW technology. WA interrogator 538 and WA responder 542 may employ antennas 540 and 544 when executing or attempting a wireless authentication. To perform a wireless authentication, WA interrogator 538 may broadcast an interrogation signal 546, schematically represented with an arrow directed toward WA responder 542. Upon receiving an interrogation signal 546 from the WA interrogator 538, WA responder 542 (which may be powered from any suitable source, including power carried by the interrogation signal 546) may reply with a response signal 548, schematically represented with an arrow directed toward the WA interrogator in FIG. 5*a*. Response signal 548 may be an authenticating response including an identification code such that WA interrogator 538 may determine whether the response signal matches a known identification code, and hence, matches an expected authenticating response. A WA interrogator 538 may be configured to register a WA status of closed only if such a successful authenticating match is made, and to register a WA status of open otherwise. After attempting a wireless authentication, the WA interrogator 538 may communicate an appropriate status of closed or open to an interlock system controller through a communication link, such as one using cable 518.

The illustrative non-contact switch 500 of FIGS. 5*a* and 5*b* may include a magnetic pair including a magnet 550 and a magnetic sensor 552. The magnetic pair may be configured to register a magnetic status of open or closed depending on the relative displacement and/or orientation of the magnet 550 and magnet sensor 552. In some illustrative embodiments, the magnetic pair is configured to register a magnetic status of closed or open, depending on whether a magnet distance between the magnet and magnet sensor is beyond a threshold magnet distance. If the magnet distance is beyond a threshold magnet distance, the magnetic pair may register a magnetic status of open, and if the magnet distance is within a threshold magnet distance, the magnetic pair may register a magnetic status of closed. The magnetic pair of FIGS. 5*a* and 5*b* may be based upon any suitable magnetic technology, and magnetic sensor 552 may be any suitable magnetic sensor. In FIGS. 5*a* and 5*b*, magnetic sensor 552 is schematically illustrated as a magnetically-actuated switch that closes (conducts) when first part 502 and second part 504 of switch 500 are disposed within a threshold magnet distance (FIG. 5*a*), and opens (does not conduct) when the parts are separated by more than the threshold magnet distance (FIG. 5*b*). In FIGS. 5*a* and 5*b*, magnetic sensor/switch 552 is schematically illustrated as being electrically disposed between a power supply 554 and WA interrogator 538. As such, magnetic sensor/switch 552 may allow (when closed) or prevent (when open) provision of power from power supply 554 to WA interrogator 538. When deprived of power, WA interrogator 538 may be unable to wireless interrogate WA responder 542. In some illustrative embodiments, a magnetic sensor/switch may not physically make or break an electrical connection between a power supply and a WA interrogator, but may provide a signal of magnetic status (closed or open), and the WA interrogator may then be configured to not attempt a wireless interrogation of a WA responder if receiving a signal indicating magnetic status of open. Regardless of the exact configuration, illustrative non-contact switch 500 may be configured to register a status of closed only if the magnetic pair registers a magnetic status of closed, and the WA pair registers a WA status of closed.

In some illustrative embodiments, hardware requirements may be reduced by combining multiple second parts (each with a WA responder) to provide multiple switches that operate with a single first part (with a WA interrogator), and a single communication link to an interlock system controller. Unique identifying codes associated with the distinct second parts may make it possible for a single first part to serve multiple switches. Such an arrangement may be feasible, for example, with double doors closing onto a common center pillar.

The disclosure should not be considered limited to the particular examples described above. Various modifications, equivalent processes, as well as numerous structures to which the disclosure can be applicable will be readily apparent to those of skill in the art upon review of the instant specification.

What is claimed is:

1. A redundant non-contact switch for reporting a status as closed or open for a first member and a second member that move relative to each other between an open state and a closed state, comprising:

a wireless authentication (WA) pair, including:

a WA responder attached to one of the first member and the second member;

a WA interrogator attached to the other of the first member and the second member;

the WA pair configured to register a WA status of closed or open, depending on a WA authentication between the WA responder and the WA interrogator;

a magnetic pair, including:

a magnet attached to one of the first member and the second member;

a magnet sensor attached to the other of the first member and the second member;

the magnetic pair configured to register a magnetic status of closed or open, depending on whether a magnet distance between the magnet and magnet sensor is beyond a threshold magnet distance; and the redundant non-contact switch configured to report the status as closed only if both the WA status is registered as closed and the magnetic status is registered as closed.

2. The redundant non-contact switch of claim 1, wherein the WA responder requires operational power to perform the WA authentication.

3. The redundant non-contact switch of claim 2, wherein the WA responder wirelessly receives operational power from the WA interrogator, wherein sufficient operational power is received by the WA responder only when a WA distance between the WA responder and the WA interrogator is below a threshold WA distance.

4. The redundant non-contact switch of claim 2, wherein the WA responder, WA interrogator, magnet, and magnet sensor are arranged on the first member and second member such that the magnet distance and WA distance vary as the first member and second member move between the open and closed states.

5. The redundant non-contact switch of claim 1, wherein the magnet sensor includes a magnetically-actuated switch that registers a magnetic status of closed when the magnet is brought within the threshold magnet distance of the magnetically-actuated switch, and a magnetic status of open when the magnet is moved away from the magnetically-actuated switch by more than the threshold magnet distance.

6. The redundant non-contact switch of claim 5, wherein the magnetically-actuated switch, when closed, allows power to be provided to the WA interrogator, and when open, does not allow power to be provided to the WA interrogator.

7. The redundant non-contact switch of claim 1, wherein:

the WA interrogator and the magnet sensor are both attached to the same one of the first member or second member;

the WA responder and the magnet are both attached to the other one of the first member or second member; and the magnet sensor is configured to allow transmission of a signal by the WA interrogator when the magnetic status is registered closed, and to prevent transmission by the WA interrogator when the magnetic status is registered open.

8. The redundant non-contact switch of claim 1, wherein:

the WA interrogator and the magnet are both attached to the same one of the first member or second member;

the WA responder and the magnet sensor are both attached to the other one of the first member or second member; and the magnet sensor is configured to allow reception of a signal by the WA responder when the magnetic status is registered closed, and to prevent reception by the WA responder when the magnetic status is registered open.

9. The redundant non-contact switch of claim 1, wherein the WA interrogator includes an inductive power transmit coil and the WA responder includes an inductive power receive coil.

10. The redundant non-contact switch of claim 9, wherein the magnetic pair is configured to allow power transmission from the inductive power transmit coil of the WA interrogator to the inductive power receive coil of the WA responder when the magnetic status is registered closed, and to prevent power transmission from the inductive power transmit coil of the WA interrogator to the inductive power receive coil of the WA responder when the magnetic status is registered open.

11. A secure non-contact switch, comprising:

a wireless authentication (WA) pair including a WA responder and a WA interrogator, the WA pair configured to register a WA status of closed or open, the WA status depending on a WA authentication between the WA responder and the WA interrogator; and a magnetic pair including a magnet and a magnet sensor, the magnetic pair configured to register a magnetic status of closed or open, the magnetic status depending on a magnet distance between the magnet and magnet sensor;

the secure non-contact switch configured to report a closed status only if both the WA status is registered as closed and the magnetic status is registered as closed.

12. The secure non-contact switch of claim 11, wherein the WA authentication depends, in part, on a WA distance between the WA responder and the WA interrogator.

13. The secure non-contact switch of claim 12, wherein the WA responder requires operational power to perform the WA authentication.

14. The secure non-contact switch of claim 13, wherein the WA responder wirelessly receives operational power from the WA interrogator, wherein sufficient operational power is received by the WA responder only when a WA distance between the WA responder and the WA interrogator is below a threshold WA distance.

15. The secure non-contact switch of claim 11, wherein the magnet sensor is configured to affect the operation of the WA pair.

16. A method for redundantly assessing an open or closed status of a non-contact switch, the non-contact switch including a wireless authentication (WA) pair that includes a WA responder and a WA interrogator, and a magnetic pair that includes a magnet and a magnet sensor, the method comprising:

registering a magnetic status of the magnet pair as open or closed;

attempting a WA authentication if the magnetic status is closed and preventing the WA authentication if the magnetic status is open, the attempting step including the steps of:

broadcasting a interrogation signal from the WA interrogator;

receiving the interrogation signal by the WA responder;

replying with a response signal by the WA responder after receiving the interrogation signal;

receiving the response signal by the WA interrogator; and determining if the response signal matches a known identification code; and reporting the status of the non-contact switch as closed only if the response signal matches the known identification code.

17. The method of claim 16, wherein the magnet sensor includes a magnetic relay switch, and the preventing step includes having the magnetic relay switch prevent at least one of the steps of broadcasting the interrogation signal and receiving the interrogation signal.

18. The method of claim 16, wherein the registering step includes finding the magnetic status to be closed if the magnet is within a threshold distance of the magnet sensor.

19. The method of claim 16, wherein the step of broadcasting a interrogation signal includes powering an inductive power transmit coil, and the step of receiving the interrogation signal includes receiving energy inductively with an inductive power receive coil from the inductive power transmit coil, the receiving energy being sufficient to power the step of replying with the response signal.

20. The method of claim 16, wherein the non-contact switch further includes a bypass disarming key having a bypass WA responder with a bypass identification code, and further wherein the step of reporting the status of the non-contact switch further includes reporting the status of the non-contact switch as closed if the non-contact switch determines that a response signal from the bypass WA responder matches a known bypass identification code.

21. The method of claim 16, further comprising the step of logging information about one or more attempted status changes of the non-contact switch.

22. A redundant non-contact interlock switch for reporting an interlock status as closed or open for a first member and second member that move relative to each other between an open state and a closed state, comprising:

a magnetic switch that is registered as closed when the first member and the second member are in the closed state;

a wireless authentication (WA) pair including a WA responder and a WA interrogator, the WA pair registered as closed when:

the first member and the second member are in the closed state; and the WA responder and the WA interrogator successfully complete a WA authentication; and the redundant non-contact interlock switch is configured to report the interlock status as closed only if both the WA pair is registered as closed and the magnetic status is registered as closed.

23. A secure non-contact switch, comprising:

an inductive power transmission pair including an inductive power transmit coil and an inductive power receive coil, the inductive power receive coil only receiving sufficient operational power from the inductive power transmit coil when the transmit and receive coils are positioned within a threshold distance of each other; and a wireless authentication (WA) pair including a WA interrogator and a WA responder, the WA responder requiring sufficient operational power from the inductive power receive coil to provide an authenticating response to an interrogation from the WA interrogator;

the secure non-contact switch reporting a status of closed only if the authenticating response received by the WA interrogator from the WA responder matches an expected authenticating response.

* * * * *